United States Patent [19]

Phillips

[11] Patent Number: 4,901,491

[45] Date of Patent: Feb. 20, 1990

[54] CONCRETE BUILDING CONSTRUCTION

[76] Inventor: Donald W. Phillips, 8514 IH 37, Corpus Christi, Tex. 78410

[21] Appl. No.: 267,971

[22] Filed: Nov. 7, 1988

[51] Int. Cl.[4] ..... E04B 1/04; E04B 5/17

[52] U.S. Cl. ..... 52/274; 52/250; 52/602; 52/293

[58] Field of Search ..... 52/602, 169.1, 293, 52/292, 169.8, 296, 722, 622, 250, 587, 227, 274

[56] References Cited

U.S. PATENT DOCUMENTS

| | | | |
|---|---|---|---|
| 722,417 | 3/1903 | Villet | 52/722 |
| 1,383,183 | 6/1921 | Aschauer | 52/602 |
| 1,460,941 | 7/1923 | Broughton | 52/92 |
| 1,578,904 | 3/1926 | Moeb | 52/296 |
| 1,702,340 | 2/1929 | Gates | 52/227 |
| 1,891,837 | 12/1932 | Pittman | 52/602 |
| 1,964,131 | 6/1934 | Nelson et al. | 52/602 |
| 2,083,987 | 6/1937 | Davis | 52/601 |
| 2,103,152 | 12/1937 | Douglass . | |
| 2,104,874 | 1/1938 | Levy | 52/92 |
| 2,202,748 | 5/1940 | Muse | 52/274 |
| 2,387,659 | 10/1945 | Hafsos . | |
| 2,592,634 | 4/1952 | Wilson | 52/262 |
| 2,652,713 | 9/1953 | Senglar . | |
| 2,854,841 | 10/1958 | Simmons . | |
| 3,239,913 | 3/1968 | Richmond | 52/587 |
| 3,289,362 | 12/1966 | Whelan | 52/92 |
| 3,979,863 | 9/1976 | Hurley | 52/92 |
| 4,015,399 | 4/1977 | Prins | 52/92 |
| 4,067,165 | 1/1978 | Timmons | 52/238 |
| 4,080,771 | 3/1978 | Weller | 52/735 |
| 4,488,385 | 12/1984 | Teasel et al. | 52/92 |
| 4,569,167 | 2/1986 | Staples | 52/90 |
| 4,676,035 | 6/1987 | GangaRao | 52/125.5 |

FOREIGN PATENT DOCUMENTS

| | | | |
|---|---|---|---|
| 789172 | 1/1958 | United Kingdom | 52/602 |

OTHER PUBLICATIONS

A pamphlet of Con-Wall Corporation, P.O. Box 6831, Colorado Springs, Colo.

*Primary Examiner*—James L. Ridgill, Jr.
*Attorney, Agent, or Firm*—G. Turner Moller

[57] ABSTRACT

A building comprises a plurality of concrete corner posts connected by generally planar vertical concrete wall panels. The wall panels include an enlarged footer which rests on an underlying ground surface, as opposed to being connected to an underlying poured concrete foundation. The wall panels include a central web having vertical ribs on the sides extending into the interior of the building. The wall panels are connected to each other and to the corner posts by welding together metal straps embedded in the concrete wall panels and corner posts. The exterior of the wall panels comprise the exterior of the building and may be finished by tinting the concrete before pouring, by exposing some of the aggregate in the panel or other conventional techniques. The interior of the wall panels are typically finished by securing insulation to the space between the ribs of the panels and then covering the interior with paneling or drywall.

9 Claims, 2 Drawing Sheets

FIG. 1
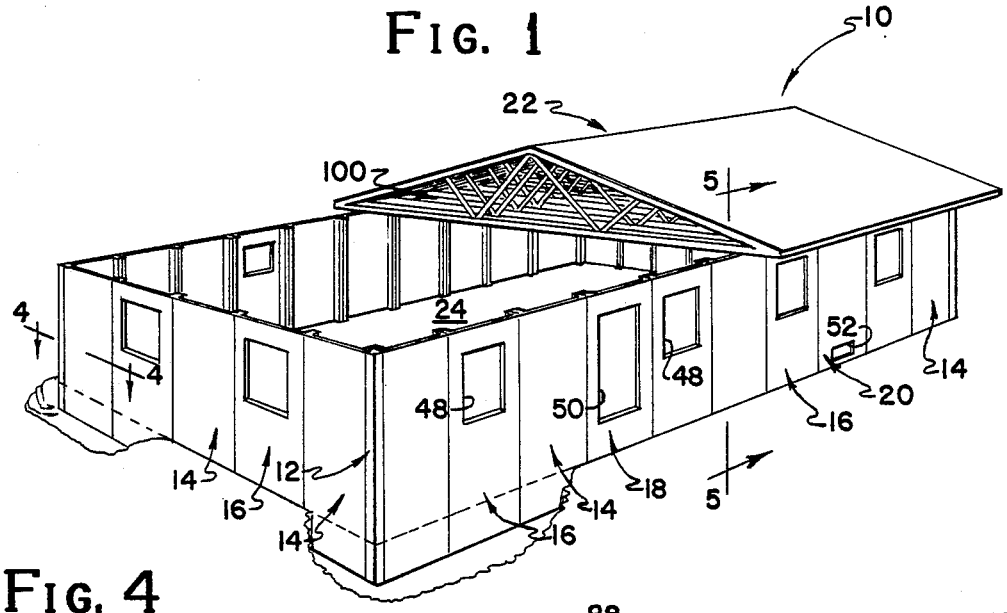
FIG. 4
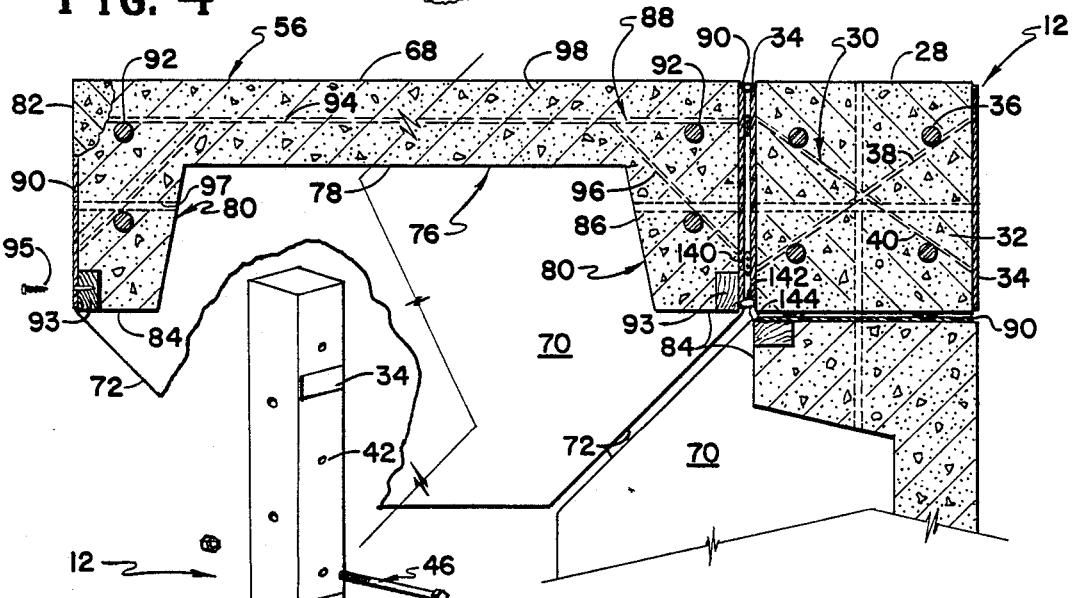
FIG. 2

CONCRETE BUILDING CONSTRUCTION

This invention relates to a concrete building construction including a series of wall sections resting on an underlying ground surface.

The most common type small building in the United States today involves pouring a concrete formation, erecting a wooden frame on the foundation and then covering the wooden frame to form inside and outside walls. These are often called "stick built" buildings because they are constructed one stick at a time. Thus, stick built buildings have a high labor content. Most residential construction is stick built.

Another common type small building involves pouring a concrete foundation, pouring a series of concrete wall panels, erecting the wall panels on the foundation and then covering the inside of the wall panels to provide the inside building wall. These buildings are often called "tilt wall" buildings because the wall panels are tilted into place. These buildings are extremely sturdy because the wall panels are bolted or welded together. Because the exterior of the building is the exterior of the wall panels, the building may be tastefully finished in a maintenance free manner merely by tinting the concrete or exposing some of the aggregate. While the labor content of tilt wall buildings is less than stick built buildings, they remain quite expensive. Tilt wall construction is mainly used in small commercial or industrial buildings.

The Con-Wall Corporation of Colorado Springs, Colo. apparently offered for sale a building comprised of a plurality of concrete wall sections having a triangular wedge shaped footer at the bottom that acted as the building support in lieu of a poured concrete foundation. The wall panels were connected to each other at the corner and were of a double-T cross-sectional shape. It is this type construction that this invention most nearly relates.

The prior art is replete with concrete and other wall panel systems as shown in U.S. Pat. Nos. 1,460,941; 2,103,152; 2,104,874; 2,387,659; 2,652,713; 2,854,841; 3,979,863; 4,015,399; 4,067,165; 4,488,385; 4,569,167; and 4,676,035. U.S. Pat. Nos. 3,289,362 and 4,080,771 are relevant for the disclosure of attaching roof trusses to vertical building walls.

The building of this invention comprises a plurality of corner posts connected to a series of concrete wall panels. The corner posts and wall panels are of substantially the same height. The wall panels interconnect the corner posts and comprise a footer having a bottom supported on an underlying ground surface and a wall section extending upwardly from the footer. The wall section includes a pair of parallel sides, a web providing a generally planar exterior wall and an interior wall, and first and second vertical ribs on the interior wall extending away from the web along the sides of the wall section. The footer bottom provides a load bearing support on the underlying ground surface and is of substantial cross-sectional area. To provide a corner, a rib of two wall panels are connected to two of the intersecting sides of the corner posts. To lengthen the wall extending away from the corner posts, additional wall panels are connected together.

It is accordingly an object of this invention to provide an improved concrete building.

Another object of this invention is to provide a concrete building that eliminates a conventional poured concrete foundation.

A further object of this invention is to provide a concrete building that is quickly and easily erected from precast components, which is extremely sturdy and which avoids many of the problems of prior art concrete buildings.

These and other objects and advantages of this invention will become more fully apparent as this description proceeds, reference being made to the accompanying drawings and appended claims.

IN THE DRAWINGS

FIG. 1 is an isometric view of a concrete building of this invention, certain parts being broken away for clarity of illustration;

FIG. 2 is an enlarged partial isometric view of a corner post of this invention;

FIG. 4 is an enlarged horizontal cross-sectional view of the building of FIG. 1, taken substantially along line 4—4 thereof as viewed in the direction indicated by the arrows;

Figure 6:
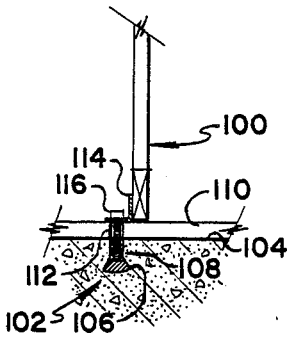
FIG. 6 is an enlarged cross-sectional view of the joint between the upper end of the wall panel and the roof.
Figure 5:
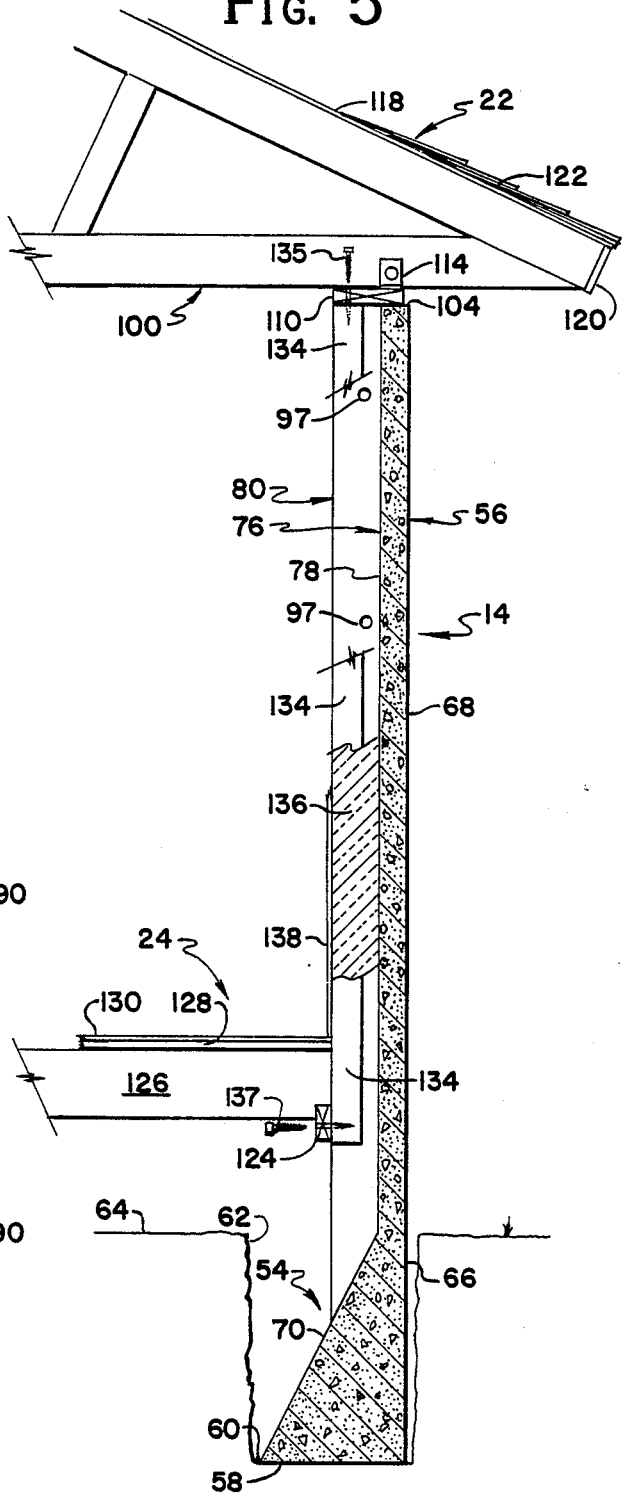
FIG. 5 is an enlarged vertical cross-sectional view of the building of FIG. 1, taken substantially along line 5—5 thereof as viewed in the direction indicated by the arrows.
Figure 3:
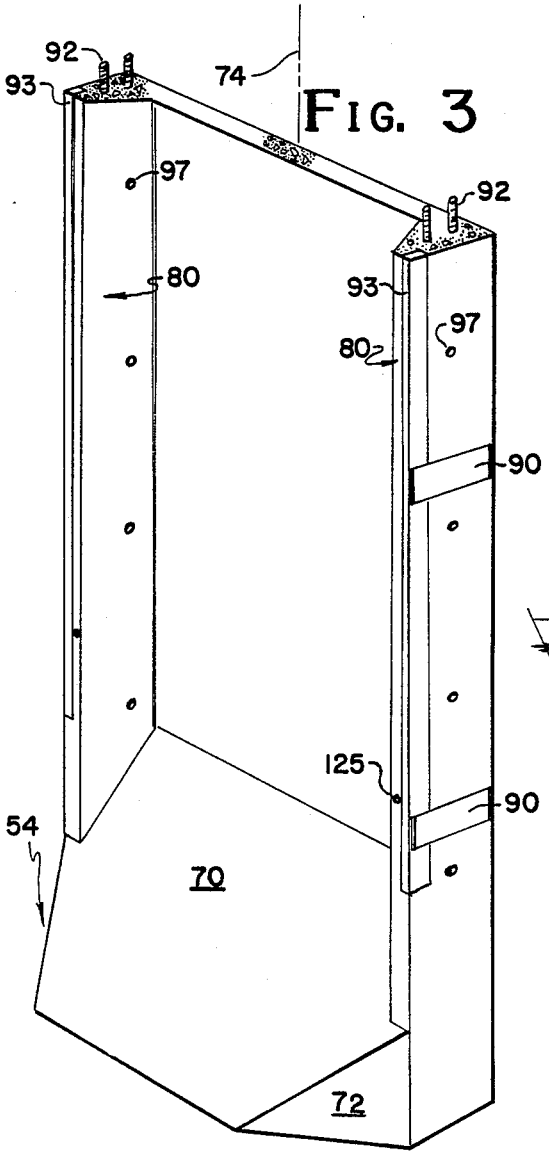
FIG. 3 is an enlarged partial isometric view of a wall panel of this invention.

Referring to FIGS. 1–6, there is illustrated a concrete building 10 of this invention comprising, as major components, a plurality of corner posts 12, a plurality of wall panels 14, 16, 18, 20, a roof 22 and a floor 24. The wall panels 14, 16, 18, 20 are of the same type construction and differ only in the type or lack of conventional openings therethrough.

As shown best in FIGS. 2 and 4, the corner posts 12 are preferably square having opposite parallel faces 26, 28 and comprise a metallic reinforcing network 30 inside a mass of poured concrete 32. The network 30 includes a plurality of weld plates 34 exposed through both faces 26, a plurality of vertical reinforcing rods 36 and a series of horizontal diagonal reinforcing rods 38, 40 welded to the weld plates 34 and to the vertical rods 36. Thus, the network 30 is welded together and placed in a mold (not shown) prior to pouring concrete therein. Because the components of the network 30 are secured together, the forces generated by pouring concrete in the mold do not substantially misalign the weld plates 34 or rods 36, 38, 40.

The mold (not shown) is provided with inserts (not shown) to produce a series of horizontal passages 42 extending between the parallel faces 26 and a series of horizontal passages 44 extending between the parallel faces 28. When erecting the building 10, nut and bolt assemblies 46 are placed in the passages 42, 44 to align and force the adjacent wall panels against the corner posts 12 so they can be welded together at the weld plates 34. The nut and bolt assemblies 46 are then removed and the passages 42, 44 plugged with cement or other material.

The wall panels 14 have no openings therethrough while the wall panel 16 includes a window opening 48, the wall panel 18 includes a door opening 50, and the wall panel 20 includes a crawl space vent opening 52. The openings 48, 50, 52 have exposed raw concrete edges that are framed in during finishing of the building 10 but do not have an interior concrete rib therearound. The wall panels 14–20 are otherwise substantially identical and conveniently are 4′ wide to be compatible with conventional 4′ wide building materials such as drywall, paneling and the like. The inside ceiling in the building 10 is preferably 8′ high to be compatible with conventional building materials. As pointed out more fully hereinafter, the floor 24 is conveniently of wood joist construction and is about 2′ above ground level. The panels 14–20 are preferably placed in a trench about 2′ deep so the panels 14–20 are preferably 12′ high.

The panels 14–20 include a footer 54 merging with a vertical wall section 56. The footer 54 is generally triangular in crosssection having an enlarged bottom 58 resting on a ground surface 60 in a trench 62 dug below ground level 64. After the corner posts 12 and wall panels 14–20 are erected and connected, the trench 62 is preferably back filled with excavated soil, sand or the like. Depending on the soil conditions at the site, the trench 62 may be deeper than illustrated and then partially filled with crushed limestone or the like. The footer 54 includes an exterior wall 66 coplanar with the exterior wall 68 of the wall section 56 and an inclined interior wall 70. As shown best in FIG. 3, the footer 54 includes side walls 72 inclined with respect to a central plane 74 of symmetry. The side walls 72 conveniently incline to avoid interference with adjacent wall panels, particularly adjacent the corner posts 12.

The wall section 56 includes a web 76 having the exterior wall 68 and an interior wall 78. Extending inwardly from the web 76 along the vertical sides thereof are a pair of vertical generally trapezoidal ribs 80 having faces 82 parallel to the plane 74 and to the corner post faces 26. The ribs 80 include inner faces 84 substantially parallel to the exterior wall 68 and inclined faces 86 merging between the faces 84 and the interior wall 78.

The panels 14–20 include a metallic network 88 having a plurality of weld plates 90 exposed through both faces 82, a plurality of vertical reinforcing rods 92 inside the ribs 80 and a series of horizontal reinforcing rods 94 spaced vertically inside the web 76. The weld plates 90 and horizontal rods 94 are spaced vertically inside the web 76 to align with the weld plates 34 of the corner posts 12, conveniently on 3′ centers. The horizontal rods 94 are welded to the weld plates 34 and some of the vertical rods 92. The remaining vertical rods 92 are welded to diagonal horizontal rods 96 which are also welded to the weld plates 90 and horizontal rods 94. For purposes more fully apparent hereinafter, a pair of furring strips 93 are secured to the metallic network 88 by suitable threaded fasteners 95 extending through openings in the weld plates 90. The furring strips 93 are wood and are conveniently 1″×2″, 2″×2″ or the like. It will be seen that the network 88 is welded together and placed in a mold (not shown) prior to pouring concrete 98 therein. Because the components of the network 88 are secured together, the forces generated by pouring concrete in the mold do not substantially misalign the weld plates 90, the rods 92, 94, 96 or the furring strips 93. Rather than including a wire mesh in the web 76, it is preferred to incorporate loose fibers in the concrete. The mold (not shown) is provided with inserts (not shown) to produce a series of horizontal passages 97. When erecting the building 10, the nut and bolt assemblies 46 are placed in the passages 42, 44, 97 to align and force the adjacent wall panels against the corner posts 12 so they can be welded together at the weld plates 34, 90.

The corner posts 12 are preferably square with each face 26, 28 being the same width as the faces 82 of the wall panels 14–20. The faces 26, 28, 82 are desirably 8″ wide and the web 76 is desirably 3″ thick. It will be seen that the diagonal reinforcing rods 96 and the inclined face 86 of the ribs 80 act as a gusset to strengthen the wall panels 14–20.

The roof 22 is of conventional design and includes a plurality of spaced pre-fabricated trusses 100 which are connected to the wall panels 14–20 by an anchor 102 embedded in the wall panel and exposed through an upper face 104. The anchor 102 is of conventional design and comprises an enlarged base 106 having an upper smaller interiorly threaded section 108. A wooden upper plate 110, such as a 2″×8″ board, is placed over the upper panel face 104 and holes 112 drilled in alignment with the threaded sections 108 of the anchors 102. As shown best in FIG. 5, the upper plate 110 is coplanar with the inner face 84 of the ribs 80. An angle 114, conveniently 3″×3″, is connected to the upper plate 110 and anchor 102 by a bolt 116. The trusses 100 are laid across the upper plates 110 and connected to the angles 114 in any suitable manner, as by bolting them together. Plywood 118, facia boards 120 and roofing material, such as shingles 122, are then placed over the trusses 100 in a conventional manner to provide the roof 22.

The floor 24 may be of any suitable type. In buildings where the distance across the short dimension is relatively modest, the floor 24 is preferably wooden. To this end, a sill or runner 124 is connected to the ribs 80, as by use of a bolt extending into an anchor 125, similar to the anchor 102, embedded in the ribs 80. The sills 124 are accordingly placed along both sides of the long dimension of the building 10 at a location on the ribs 80 to provide a conventional 8′ ceiling after the floor 24 is finished. A plurality of joists 126 extend between the sills 124 and are secured thereto. The joists 126 are spaced so those adjacent the short dimension of the building 10 abut the faces 84 of the ribs 80 and likewise are secured to the anchors 125. Plywood sheets 128 are secured to the joists 126. Any suitable type floor covering 130, such as carpet, vinyl tile or vinyl sheet, is then secured to the plywood 128.

In the event the owner wants a poured concrete floor, many different approaches are easily accomplished. First, reinforcing rods (not shown) may be placed in and welded to the anchors embedded in the ribs 80 to provide a horizontal mat on which concrete is poured. In this event, the panels 14 are buried in the ground so the anchors and reinforcing rods (not shown) are only slightly above the ground level 64. Second, if the panels 14 are not buried deeper in the ground, the inside of the building 10 can be backfilled with sand to raise the ground level 64 to adjacent the anchors in the ribs 80. In any event, a concrete slab may be poured inside the panels 14–20, after the trench 62 is backfilled.

To begin finishing the interior, wooden 2″×4″ studs 134 or their metallic equivalent are positioned midway between the ribs 80 and secured in place. Conveniently, the upper end of the studs 134 are secured, by nails or screws 135, to the top plate 110. The lower end of the studs 134 are secured to the sills 124 along the long dimension of the building by lag bolts 137 or other suitable fasteners. Along the short dimension of the building, the lower end of the studs 134 are secured by similar lag bolts to those joints 126 which abut the ribs 80. Because the depth of the ribs 80 is on the order of about 5" and the inside of the studs 134 are coplanar with the rib faces 84, the 2"×4" studs 134 do not reach the inside wall 78 of the web 76. Thus, the sound and thermal insulating qualities of the wall panels 14–20 are better than if the studs 134 reached the web 76.

Because the distance between the roots of the ribs 80 is about 40" and the distance between the outer ends of the ribs is about 42", the stud 134 divides the space between the ribs 80 into two vertically unobstructed sections. Insulating batts 136 are secured in these sections in any suitable fashion. Drywall or paneling 138 is nailed to the studs 134 and to the furring strips 93 inside the ribs 80 and finished in any suitable manner.

Erection of the shell of the building 10 should now be apparent. A ditching machine or back hoe is used to dig the trench 62 and install water, gas and sewer conduits. The corner posts 12 and wall panels 14–20 are precast at a central location and trucked to the site. One would normally think that the corner posts 12 are placed first and the wall panels 14–20 attached to them. To the contrary, by use of a crane, one of the wall panels 14–20 is first placed in the trench 62 adjacent a corner and leveled. A pair of elongate foam sealing strips 140 are adhesively attached to the corner post 12 or adjacent wall panel. The corner post 12 is then placed in the trench 62. The corner post 12 and adjacent wall panel are aligned and the nut and bolt assemblies 46 are inserted through the aligned passages 42, 97. The nut and bolt assemblies 46 are threadably tightened to compress the sealing strips 140 and bring the weld plates 34, 90 close together. The weld plates 34, 90 are then welded together. The nut and bolt assemblies 46 are then removed.

The sealing strips 140 are applied to the corner post 12 and the next panel 14–20 is placed in the trench 62 next to the adjacent side of the corner post 12. This panel is then leveled and the nut and bolt assemblies 46 are placed in the aligned passages 44, 97 and tightened to compress the sealing strips 140 and draw the weld plates 34, 90 together. The weld plates 34, 90 are welded together and the assemblies 46 removed. Suitable caulking material (not shown) may be placed in the gaps between the wall panels and between the corner posts and wall panels to enclose the weld material 142 and prevent it from rusting.

As shown in FIG. 4, the corner posts 12 are unusual because the weld plates 34 are on opposite faces 26. One of the adjacent wall panels 14–20 has its weld plate 90 parallel to the corner post weld plate 34 so the weld material 142 is placed in the gap between them. The other wall panel has its weld plate 90 perpendicular to the corner post weld plate 34 so the weld material 144 extends between the edges of the weld plates 34, 90. The corner posts 12 are accordingly symmetrical and no great thought need be taken to orient the corner posts 12 correctly.

It will accordingly be seen that the building 10 of this invention is quick and simple to erect, does not require a finished concrete foundation, is sturdy and durable, and provides an inexpensive maintenance free exterior.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A building comprising a vertical corner post having a pair of first parallel sides and a pair of second parallel sides perpendicular to the first sides, the posts providing a first series of passages interconnecting the first sides and a second series of passages interconnecting the second sides;

a plurality of generally planar vertical concrete wall panels interconnecting the corner posts and comprising a footer having a bottom supported on an underlying ground surface;

a wall section extending upwardly from the footer having a pair of parallel sides, a web providing a generally planar exterior wall and an interior wall, first and second vertical ribs on the interior wall extending away from the web along the sizes of the wall panel;

the footer bottom being of a first cross-sectional size in a first plane through the bottom parallel to the ground surface and the wall panel being of a second cross-sectional size in a second plane parallel to the first plane, the second cross-sectional size being substantially smaller than the first size;

a first one of the wall panels having a first rib abutting one of the first sides of the corner post and providing a third series of linear passages aligned with the first passages of the corner post;

a first series of elongate tensioned fasteners extending through the aligned first and third passages closing the first wall panel against the corner post and connecting the first panel to the corner post;

a second one of the wall panels having a second rib abutting one of the second sides of the corner post and providing a fourth series of linear passages aligned with the second passages of the corner post;

a second series of elongate fasteners extending through the aligned second and fourth passages closing the first wall panel against the corner post and connecting the second panel to the corner post to provide a corner of the building; and third and fourth ones of the wall panels, respectively coplanar with the first and second wall panels, having a rib connected to the second rib of the first and second wall panels respectively.

2. The building of claim 1 wherein the wall panel includes a metallic reinforcing network and a concrete mass around the network, the network comprising first and second spaced vertical reinforcing rods in each of the ribs, a plurality of weld plates in the ribs exposed through the sides of the wall panels, a plurality of vertically spaced horizontal reinforcing rods secured to the first vertical rods and the weld plates and a plurality of short rods in the ribs secured to the weld plates, the second rods and the first rods, the short rods being inclined to the horizontal rods, the third and fourth panels having the weld plates welded together.

3. The building of claim 1 wherein the corner posts include first parallel opposing sides and second parallel opposing sides perpendicular to the first sides, a metal reinforcing network and a concrete mass around the network, the network comprising a plurality of spaced vertical reinforcing rods, a pair of weld plates exposed through the first sides of the corner post, a plurality of first horizontal reinforcing rods extending diagonally across the corner post and connected to the weld plates and to some of the vertical rods and a plurality of second horizontal reinforcing rods extending diagonally across the corner post across the first horizontal reinforcing rods and connected to the weld plates and to the remainder of the vertical rods.

4. The building of claim 1 wherein the corner posts include a pair of first parallel opposing sides and a pair of second parallel opposing sides perpendicular to the first sides, a first series of vertically spaced horizontal passages between the first parallel opposing side and a second series of vertically spaced horizontal passages between the second parallel opposing sides, a metal reinforcing network and a concrete mass around the network, the network comprising a plurality of spaced vertical reinforcing rods, a pair of weld plates exposed through the first sides of the corner post away from the first passages.

5. The building of claim 1 wherein the sides of the corner posts and the sides of the wall panels are vertical and planar and further comprising a pair of horizontally spaced, vertically extending compressible sealing strips between facing ones of the vertical sides, the sealing strips being compressed between the facing vertical sides and comprising the sole sealing means between the wall panels and corner posts.

6. The building of claim 1 wherein the ribs comprise a pair of parallel interior faces and a nailing strip exposed through the interior faces.

7. The building of claim 6 further comprising a top plate extending along and supported by an upper surface of the wall panel ribs;

means connecting the top plate to the wall panels;

a sill, parallel to the top plate, connected to the ribs adjacent a lower end of the wall panel;

a vertical stud, between the ribs and parallel thereto, connected adjacent the upper end thereof to the top plate and adjacent the lower end thereof to the sill;

the stud having an exterior face facing the wall panel web and an interior face substantially coplanar with the interior faces of the rib, the stud having a smaller dimension from the interior face to the exterior face than from the rib face to the web; and wall covering secured to the nailing strips in the ribs and to the stud at locations between the ribs.

8. The building of claim 1 wherein the footer includes an interior wall and an interior wall inclined between the footer bottom and the web and the footer interior wall merges with the web and ribs, the footer having a first width as wide as the wall panel where the footer merges with the ribs, the footer tapering, in a horizontal plane, at an angle of at least 45°, toward the bottom and having a second width at the bottom smaller than the first width, the footers of the first and second wall panels being juxtaposed along an imaginary line at 45° to the first and second sides of the corner post.

9. The building of claim 8 wherein the footer includes a central plane of symmetry perpendicular to the web and the footer tapers symmetrically relative to the plane.

* * * * *